US007153347B2

(12) United States Patent
Kang et al.

(10) Patent No.: US 7,153,347 B2
(45) Date of Patent: Dec. 26, 2006

(54) DEVICE AND METHOD FOR CONTROLLING AIR CLEANING OPERATION OF AIR CONDITIONER

(75) Inventors: Tae Wook Kang, Gimhae-si (KR); Jae Keun Lee, Busan-si (KR); Ju Ho Ock, Masan-si (KR)

(73) Assignee: LG Electronics Inc., Seoul (KR)

( * ) Notice: Subject to any disclaimer, the term of this patent is extended or adjusted under 35 U.S.C. 154(b) by 237 days.

(21) Appl. No.: 10/701,631

(22) Filed: Nov. 6, 2003

(65) Prior Publication Data

US 2004/0144249 A1 Jul. 29, 2004

(30) Foreign Application Priority Data

Jan. 27, 2003 (KR) ..... 10-2003-0005354

(51) Int. Cl.
*B01D 46/46* (2006.01)

(52) U.S. Cl. ..... 96/422; 55/471; 55/472; 55/473; 55/385.2; 55/DIG. 34; 95/25; 95/26; 96/58; 96/397; 96/417; 96/424

(58) Field of Classification Search ..... 55/471, 55/472, 473, 385.2, DIG. 34; 96/25, 424, 96/58, 397, 417, 422; 95/25, 26
See application file for complete search history.

(56) References Cited

U.S. PATENT DOCUMENTS 4,786,295 A * 11/1988 Newman et al. ..... 96/400
6,066,194 A * 5/2000 Hugghins et al. ..... 96/397
6,280,691 B1 * 8/2001 Homeyer et al. ..... 422/122
6,464,760 B1 * 10/2002 Sham et al. ..... 96/117.5
6,660,070 B1 * 12/2003 Chung et al. ..... 96/424
2001/0029728 A1 * 10/2001 Massey et al. ..... 55/471
2004/0163542 A1 * 8/2004 Huang ..... 96/222

FOREIGN PATENT DOCUMENTS

JP 08-171389 A 7/1996

* cited by examiner

*Primary Examiner*—Duane Smith
*Assistant Examiner*—Minh-Chau T. Pham
(74) *Attorney, Agent, or Firm*—Birch, Stewart, Kolasch & Birch, LLP

(57) ABSTRACT

The present invention provides device and method for controlling air cleaning operation, in which an air conditioner with an air cleaner is made to clean air effectively proper to different pollutants. The device includes a memory having a plurality of operation modes set and stored therein for controlling operation of a fan proper to characteristics of air pollution sources, first means for selecting one of the plurality of operation modes stored in the memory, and a controlling part for controlling the fan according to a control program of the operation mode. The method includes the steps of selecting one of a plurality of operation modes, changing setting of an operation time period of the selected operation mode, reading the selected operation mode from the memory, and changing the operation time period of the operation mode to the set value, and controlling the fan according to the value of the changed operation time period and the value of the operation mode read from the memory.

20 Claims, 14 Drawing Sheets

DEVICE AND METHOD FOR CONTROLLING AIR CLEANING OPERATION OF AIR CONDITIONER

This application claims the benefit of the Korean Application No. P2003-0005354 filed on Jan. 27, 2003, which is hereby incorporated by reference.

BACKGROUND OF THE INVENTION

1. Field of the Invention

The present invention relates to air conditioners, and more particularly, to device and method for controlling air cleaning operation of an air conditioner, in which a flow rate of air passing through an air cleaner in the air conditioner and a time period thereof are varied, for removing polluted air.

2. Background of the Related Art

The air conditioner maintains room air in a condition most suitable to use and purpose of the air by using a property of refrigerant in which the refrigerant discharges/absorbs heat to/from an environment when a phase of the refrigerant changes. For an example, the room is conditioned in a cool state in summer, and in a warm state in winter.

In the meantime, recently as interest in environmental pollution becomes higher, there have been many researches not only on air pollution, but also on pollution of room air in which people have activity for a long time. In causes of the room air pollution, there can be pollution coming from pollution around the building, and coming from pollutant produced in the room. The air pollution is mostly caused by smoke, fuel gases for heating, and waste gases from factories, power plants, and the like. On the other hand, the causes of production of pollutant in the room are carbon dioxide, water vapor, and smell from people active in the room, pollution from smoking, dust from different works done in the room, and combustion gas or water vapor from different combustion devices.

Other than above causes, the yellow sand frequently occurred in dry seasons, and the enormous pollen flying in spring also pollute air, which cause allergy to a human body, directly.

In the meantime, by the researches, it is known that the polluted air, bad smell, and cigarette smoke in an enclose space, a car, or a building, not only harm human body, but also drop working efficiency and productivity, to cause direct or indirect social cost. Therefore, it becomes very important that comfortable and fresh is supplied to the room for improving working efficiency and preventing accident caused by negligence of safety.

According to this, it is required to provide an air cleaner to the room for supplying cleaned air. However, a related art air conditioner is not provided with the air cleaner, it is required to provide the air cleaner, additionally. Moreover, since a related art air cleaner deals with various pollution sources that pollute the room air uniformly, effective cleaning of room air polluted with different pollution sources has not been possible, and energy is wasted more than necessary.

SUMMARY OF THE INVENTION

Accordingly, the present invention is directed to device and method for controlling air cleaning operation of an air conditioner that substantially obviates one or more of the problems due to limitations and disadvantages of the related art.

An object of the present invention is to provide an improved air conditioner which can cool or heat as well as clean a room.

Other object of the present invention is to provide device and method for controlling air cleaning operation of an air conditioner, which deals with different pollution sources effectively, for improving air cleaning efficiency and energy efficiency.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the device for controlling air cleaning operation of an air conditioner includes a memory having a plurality of operation modes set and stored therein for controlling operation of a fan proper to characteristics of air pollution sources, the fan drawing air, and discharging the air through an air cleaner in the air conditioner, first means for selecting one of the plurality of operation modes stored in the memory, and a controlling part for controlling the fan according to a control program of the operation mode selected by using the first means.

The operation mode may include a plurality of operation sections operative in different characteristics.

The device may further include a second means for changing setting of the operation time periods of the operation modes. In this instance, it is preferable that the controlling part controls the fan by reading the operation mode selected with the first means from the memory, and adjusting the operation time period of the operation mode to a value set with the second means.

The second means changes setting of a total operation time period of all operation sections in the operation mode, or changes setting of individual operation time periods of the operation sections of the operation mode, respectively.

In the meantime, the operation mode may include a first section for operating the fan to output a maximum air flow rate, a second section for operating the fan to output a middle air flow rate lower than the maximum air flow rate, and a third section for operating the fan to output a least air flow rate lower than the middle air flow rate.

The operation mode may include a first mode having the first section, the second section, and the third section operative in succession. The first mode, for an example, for removal of cigarette smoke may include the first section operative for a first time period, the second section operative for a second time period after finish of the first section, and the third section operative until the first mode ends after finish of the second section.

In the meantime, the operation mode may include a second mode in which the second section and the third section are operated repeatedly after the first section, the second section, and the third section are operated in succession.

The first mode for removal of yellow sand, as one of different embodiments, may include the first section operative for a third time period, the second section operative for a fourth time period after finish of the first section, the third section operative for a fifth time period after finish of the second section, and a repetitive section for repeating the second section and the third section until the second mode ends after finish of the third section.

The second mode for removal of yellow sand, as other one of different embodiments, may include the first section operative for a sixth time period, the second section operative for a seventh time period after finish of the first section, the third section operative for an eighth time period after finish of the second section, and a repetitive section for repeating the second section and the third section until the second mode ends after finish of the third section.

The repetitive section may include the second section and the third section having identical operation time periods, or the second section and the third section having different operation time periods.

In the meantime, in another aspect of the present invention, there is provided a method for controlling air cleaning operation of an air conditioner having an air cleaner and a fan for supplying air to the air cleaner, including the steps of selecting one of a plurality of operation modes programmed to control the fan proper to characteristics of air pollutants and stored in a memory, changing setting of an operation time period of the selected operation mode, reading the selected operation mode from the memory, and changing the operation time period of the operation mode to the set value, and controlling the fan according to the value of the changed operation time period and the value of the operation mode read from the memory.

The operation mode may include a plurality of operation sections for operating the fan in different characteristics.

The step of changing setting of an operation time period of the selected operation mode may include the step of changing setting of a total operation time period of the operation mode, or the step of changing setting of individual operation time periods of the operation sections of the operation mode, respectively.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given the same names and reference symbols, and repetitive description of which will be omitted.

Figure 1A:
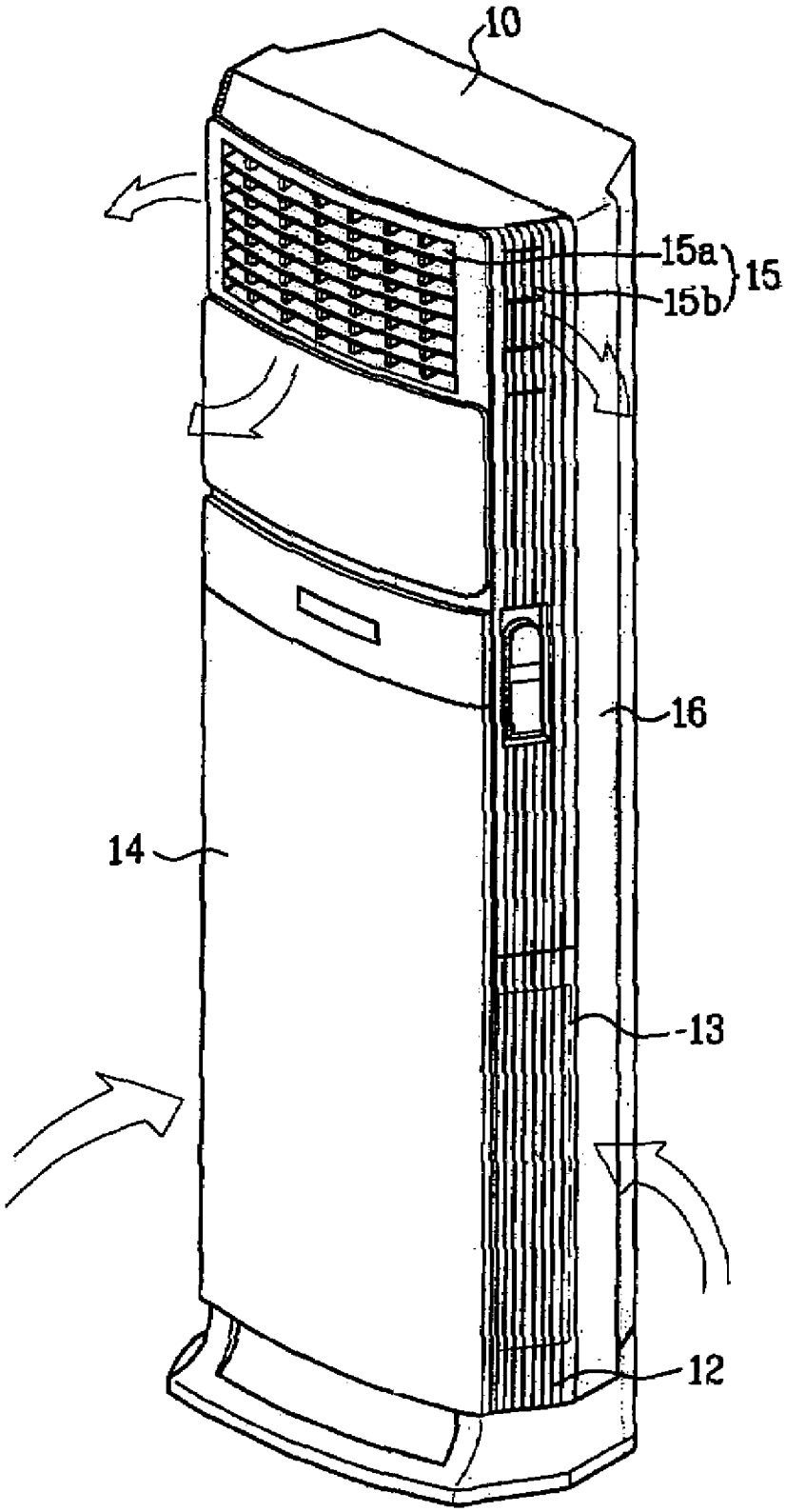
FIG. 1A illustrates a perspective view showing an air conditioner with an air cleaner in accordance with a preferred embodiment of the present invention.

An air conditioner of the present invention and an air cleaner of the present invention applied to the air conditioner will be described with reference to FIGS. 1A~1D. For reference, FIG. 1A illustrates a perspective view showing an air conditioner with an air cleaner in accordance with a preferred embodiment of the present invention, FIG. 1B illustrates a disassembled perspective view showing a structure of the air cleaner in the air conditioner in FIG. 1A, FIG. 1C illustrates a section showing an inside structure of the air cleaner in FIG. 1B, and FIG. 1D illustrates a diagram showing a principle of air cleaning of the air cleaner in FIG. 1B or 1C.

There is a cabinet 10 having inlets 13 in lower parts thereof for drawing room into an inside of the cabinet 10, and outlets 15 in upper parts thereof for discharging air from the cabinet 10. The cabinet 10 has sloped surfaces 16 each having a part sloped to face a front thereof. As shown in FIG. 1A, the inlets 13 are formed in the sloped surfaces 16 respectively, and the inlets 13 have suction grills 12 extended in an up/down direction. As shown in FIG. 1A, the outlets 15 have a front outlet 15*a* and side outlets 15*b* formed in a front surface of the cabinet 10 and in the sloped surfaces 16, respectively.

The air conditioner draws air through the inlets 13 in the side parts of the lower part of the cabinet 10, and discharges into the room through the outlets 15*a* and 15*b* in the front surface and side surfaces of the cabinet 10. According to this, the air conditioner of the present invention can condition room environment comfortable as the air conditioner of the present invention can supply air to the room uniformly more than the related art air conditioner.

Figure 1B:
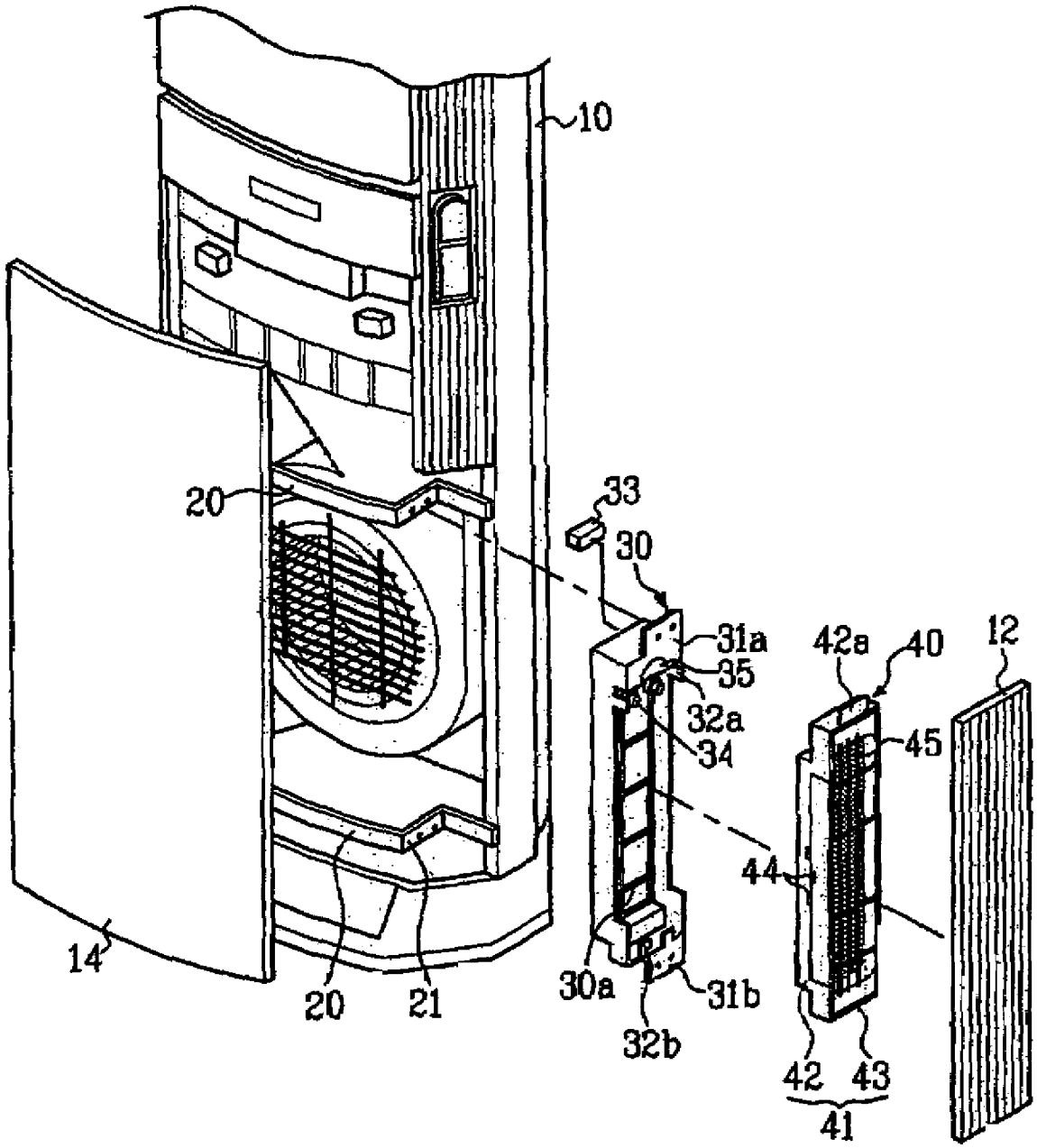
FIG. 1B illustrates a disassembled perspective view showing a structure of the air cleaner in the air conditioner in FIG. 1A.
Figure 1C:
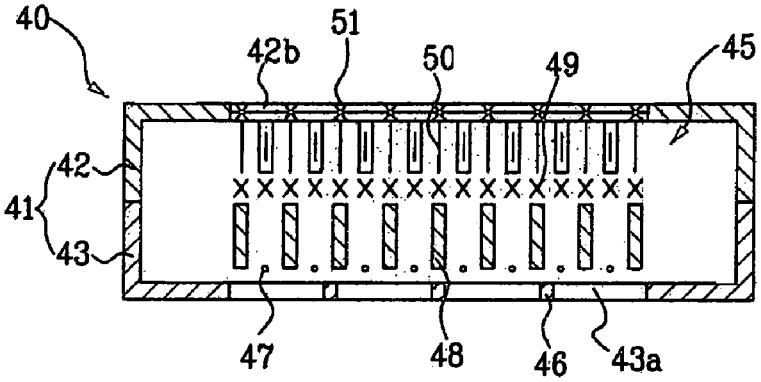
FIG. 1C illustrates a section showing an inside structure of the air cleaner in FIG. 1B.
Figure 1D:
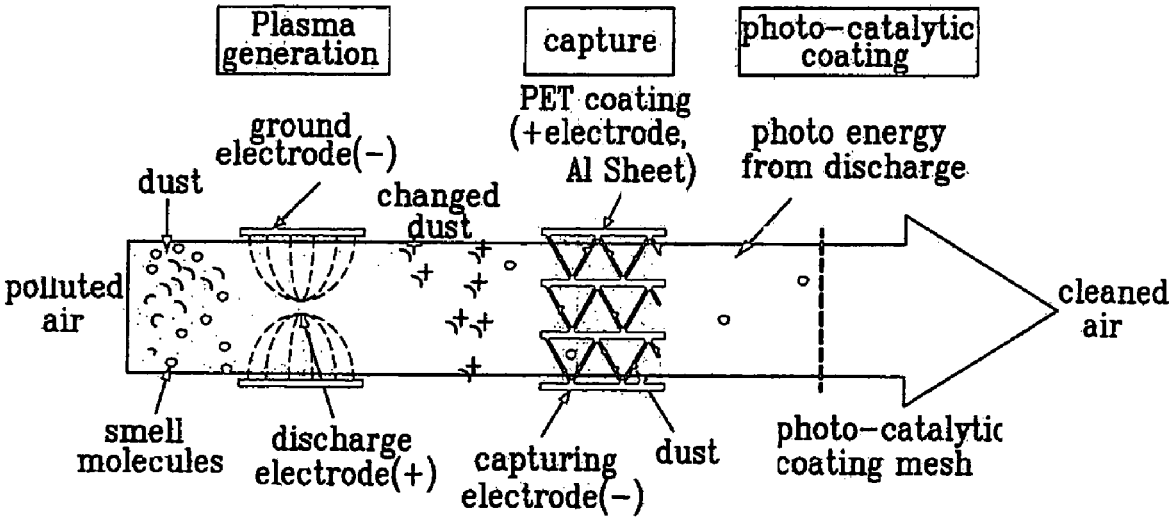
FIG. 1D illustrates a diagram showing a principle of air cleaning of the air cleaner in FIG. 1B or 1C.

In the meantime, as shown in FIG. 1B, the cabinet 10 has a front panel mounted to a front surface thereof, inlet grills 12 mounted to opposite sides thereof, and dust collectors 40 mounted inside thereof. For this, there are brackets 20 each for holding the front panel 14, the inlet grills 12, and dust collector holders 30 for holding the dust collectors 40. As shown in FIG. 1B, each of the brackets 20 has opposite bent ends, and there are two such brackets 20 fitted to positions opposite to the inlets 13 in a horizontal direction. The bracket 20 has fastening parts 21 in opposite side parts thereof to face opposite sides of the cabinet 10, to where the dust collector holders 30 are fitted as shown in FIG. 1B.

The dust collector holder 30 is extended in the up/down direction, and has passed through forms in a front/rear direction for pass of introduced air through the inlet 13. As shown in FIG. 1B, there is a reinforcing frame 30*a* in the passed through central part. The dust collector holder 30 has an upper part and a lower part fastened to the fastening part 21 of the bracket 20 with screws, for which the dust collector holder 30 has fastening parts 31*a* and 31*b* extended upward and downward, respectively. Of course, the fastening parts 31*a* and 31*b* have a plurality of screw holes for screw fastening.

The dust collector holder 30 mounted thus holds the dust collector 40 which cleans air drawn into the inside of the cabinet 10 through the inlet 13. For this, the dust collector holder 30 has hook formed projections 32*a* in an upper part of a front part thereof for holding opposite sides of the dust collector 40, and upward projections 32*b* in a lower part of the front part thereof for preventing the duct collector 40 from breaking away. Moreover, the dust collector holder 30 has a recess 35 in the upper part thereof for easy mounting/dismounting of the dust collector 40.

In the meantime, the dust collector holder 30 has a high voltage transformer 33 fitted to a rear surface of the upper part thereof for supplying a high voltage to the dust collector 40. There is a connection terminal 34 in a part the upper part of the dust collector 40 is inserted thereto for connection to an external power source.

The operation and structure of the dust collector 40 mounted to the dust collector holder 30 will be described with reference to FIGS. 1B~1D. FIG. 1C illustrates a section showing an inside structure of the air cleaner in FIG. 1B, and FIG. 1D illustrates a diagram showing a principle of air cleaning of the air cleaner in FIG. 1B or 1C.

Referring to FIG. 1C, the dust collector 40 in the air conditioner of the present invention includes a case 41 inserted in the dust collector holder 30, and a dust collecting device part 45 in the case 41 for cleaning air.

Referring to FIGS. 1B and 1C, the case 41 includes a rear case 42 for being inserted in the dust collector holder 30 and mounting the dust collecting device part 45 thereto, and a cover 43 fastened to a front part of the rear case 42 for protecting the dust collecting device part 45. Both the rear case 42 and the cover 43 have structures to pass air, for which, as shown in FIG. 1C, the rear case 42 has discharge holes 42*b*, and the cover 43 has suction holes 43*a* As shown in FIG. 1B, the rear case 42 and the cover 43 are fastened together with a plurality of fastening means 44. In the meantime, the cover 43 has a hand grip 42*a* projected upward in a front direction with slant from a top part thereof for easy mounting/dismounting of the dust collector 40.

In the meantime, the suction holes 43*a* and the discharge holes 42*b* are provided with a protection net 46 and a deodoring net 51 respectively for protecting an inside of the dust collector 40 and removing smell. Arranged between the protection net 46 and the deodoring net 51 in succession, there are a plurality of high voltage lines 47 for application of a high voltage current from a side of the suction hole 43*a*, a plurality of dust collecting steel plates 48 arranged in rear of both sides of the high voltage lines 47, a dust collecting net 49 for capturing dust and the like, and a dust collecting band 50 having an anode plate and cathode plate arranged alternately.

The dust collector 40 is assembled, and operated as follows.

Referring to FIG. 1B, the two brackets 20 are fastened to the front surface of an inside of cabinet 10, and the dust collector holders 30 are fastened to the fastening parts 21 with screws, respectively. Once the dust collector 40 is inserted in, and attached to, the dust collector holder 30, the dust collector 40 is held by the projections 32*a* and 32*b*. In the meantime, if it is intended to detach the dust collector 40, if the dust collector 40 is pulled forward holding the hand grip 42*a*, the dust collector 40 is detached from the dust collecting holder 30, easily. Once the dust collector holders 30 and the dust collectors 40 are mounted, the front panel 14 and the suction grills 12 are fastened to the cabinet 10 and the brackets 20.

Upon putting the air conditioner of the present invention into operation, the room air is introduced through the inlets 13, and discharged through the outlets 15 via the dust collectors 40. In this instance, the fine dust and bad smell are removed perfectly from the air by the dust collectors 40 according to a process shown in FIG. 1D. Of course, for enhancing an air cleaning efficiency, and maintaining a performance of the dust collector 40 for a long time, it is preferable that an anti-bacterial filter (not shown) is arranged between the dust collector 40 and the suction grill 12. Then, the air having comparatively large dust removed at the anti-bacterial filter is introduced into the dust collector 40, and, as shown in FIG. 1D, at the dust collector 40, fine dust, mold, bacteria, microbe, and various smells are removed by using photocatalytic plasma. According to this, cleaner air can be supplied to the room, uniformly.

Figure 2:
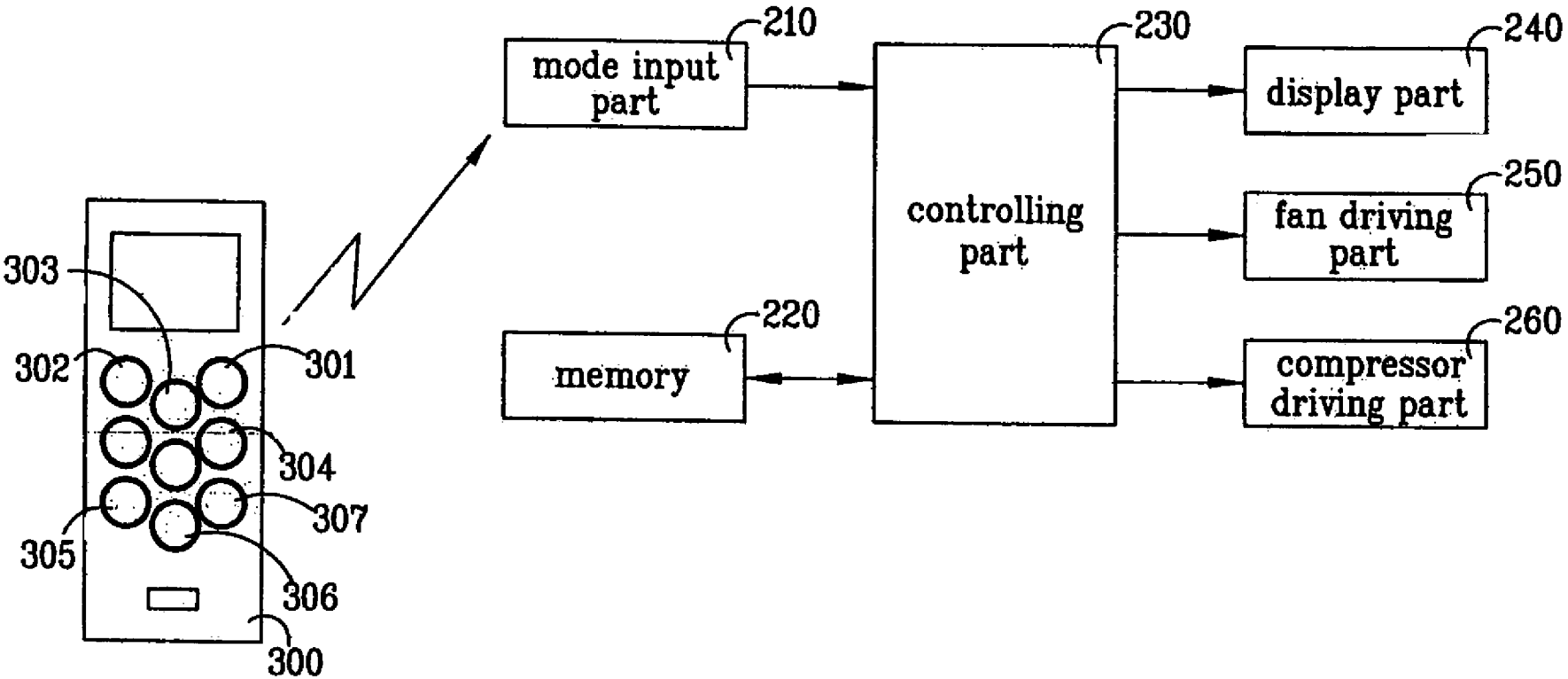
FIG. 2 illustrates a diagram showing a device for controlling air cleaning operation of an air conditioner of the present invention.

In the meantime, FIG. 2 illustrates a diagram showing a device for controlling air cleaning operation of an air conditioner of the present invention, schematically. The device for controlling air cleaning operation of an air conditioner of the present invention includes a memory having a plurality of operation modes set therein for controlling operation of a fan proper to characteristics of different air pollution sources, first means for selecting one of the operation modes stored in the memory, and a controlling part for controlling the fan according to a control program of the selected operation mode. Embodiments of the foregoing device for controlling air cleaning operation of the present invention will be described.

Referring to FIG. 2, the air conditioner of the present invention is provided with a remote controller 300 (hereafter called as remocon) having different buttons for selecting a flow rate and an air cleaning operation mode of the air conditioner. For an example, as shown in FIG. 2, flow rate selection buttons 305, 306, and 307 for selecting a flow rate of air of the fan, and a plurality of operation mode selection buttons 301, 302, and 303 for controlling the fan proper to different pollution sources. When the remocon 300 has such a structure, the user can selects a desired operation mode easily by pressing the operation mode selection buttons.

The operation mode will be described in more detail. Each of the operation modes includes a plurality of operation sections in each of which the fan is driven in characteristic different from each other. In each of the operation sections, the fan can be controlled to have, for an example, flow rates different from each other. Therefore, each operation mode includes a form composed of a first section having a maximum flow rate, a second section having an intermediate flow rate slightly smaller than the maximum flow rate, and a third section having a minimum flow rate smaller than the maximum flow rate. Accordingly, each operation mode includes a plurality of operation sections combined to remove different pollution sources, effectively.

In the air conditioner of the present invention, the operation modes which can be designated as the first, to third operation modes are, for an example, an operation mode for removing smoke from cigarette, an operation mode for removing yellow sand, and an operation mode for removing pollen. A way of combination of the operation sections for each of the operation modes will be described, later.

In the meantime, the remocon 300 is provided with a setting button 304 for manual change of setting of an operation time period of each of the operation modes. For an example, if the operation mode for removal of cigarette smoke is set, operation of the fan is controlled according to an operation program so that an amount smoke produced when two cigarettes are smoked in a space is removed effectively. Meanwhile, if the setting button 304 is pressed to change an operation time period of the operation mode, an amount of smoke produced when three or more than three cigarettes are smoke can also be removed, effectively.

In the present invention, there are two methods for changing a time period of each operation mode. One is changing setting of a total operation time period of all operation sections in each operation mode, and the other is changing setting of operation time periods of respective operation sections, individually.

For an example, most of the operation modes have different operation sections combined such that a certain amount polluted air can be removed the most effectively based on an experiment carried out under a particular condition. However, in a case the amount of pollutant in the air is different from the experiment actually, a total operation time of the operation sections in the operation mode is increased or decreased, for dealing with removal of the polluted air, effectively.

In the meantime, once a certain button on the remocon 300 is pressed, a signal relevant to the button is provided to the controlling part 230 through the mode input part 210 in the air conditioner. The controlling part 230 senses the signal received through the mode input part 210, and carries out a control relevant thereto. For an example, the controlling part 230 reads control information on a particular operation mode selected through the operation mode selection button from a memory 220. Then, information on operation time period of the operation mode read from the memory 220 is replaced with information on an operation time period changed with the setting button 304 on the remocon 300, and the fan is controlled according to a value set finally. It is preferable that a microcomputer having a timer and a memory is used as the controlling part 230 for controlling the fan thus.

Figure 3:
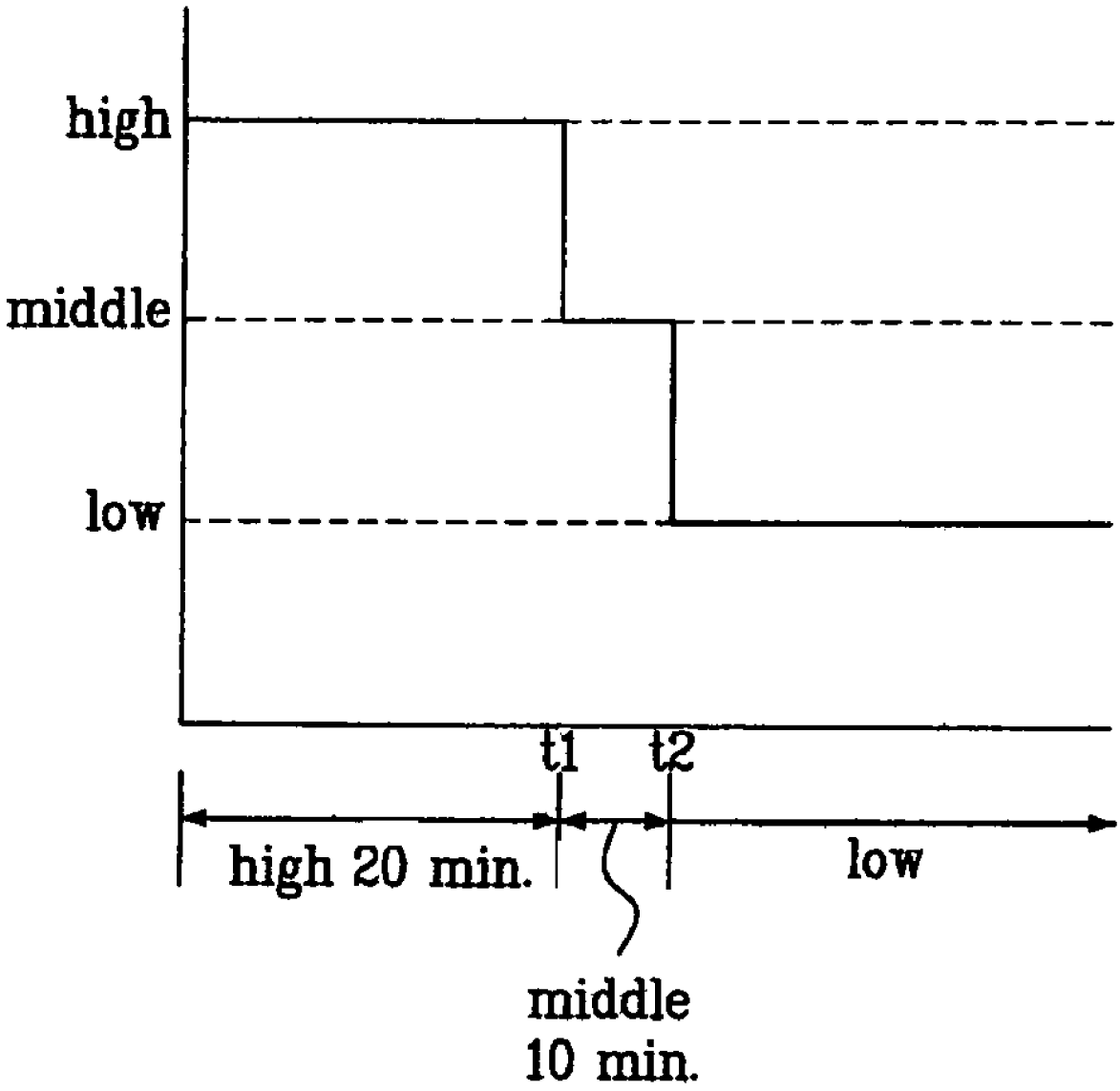
FIG. 3 illustrates a graph showing fan control in a smoke removal operation mode of the air conditioner of the present invention.
Figure 5:
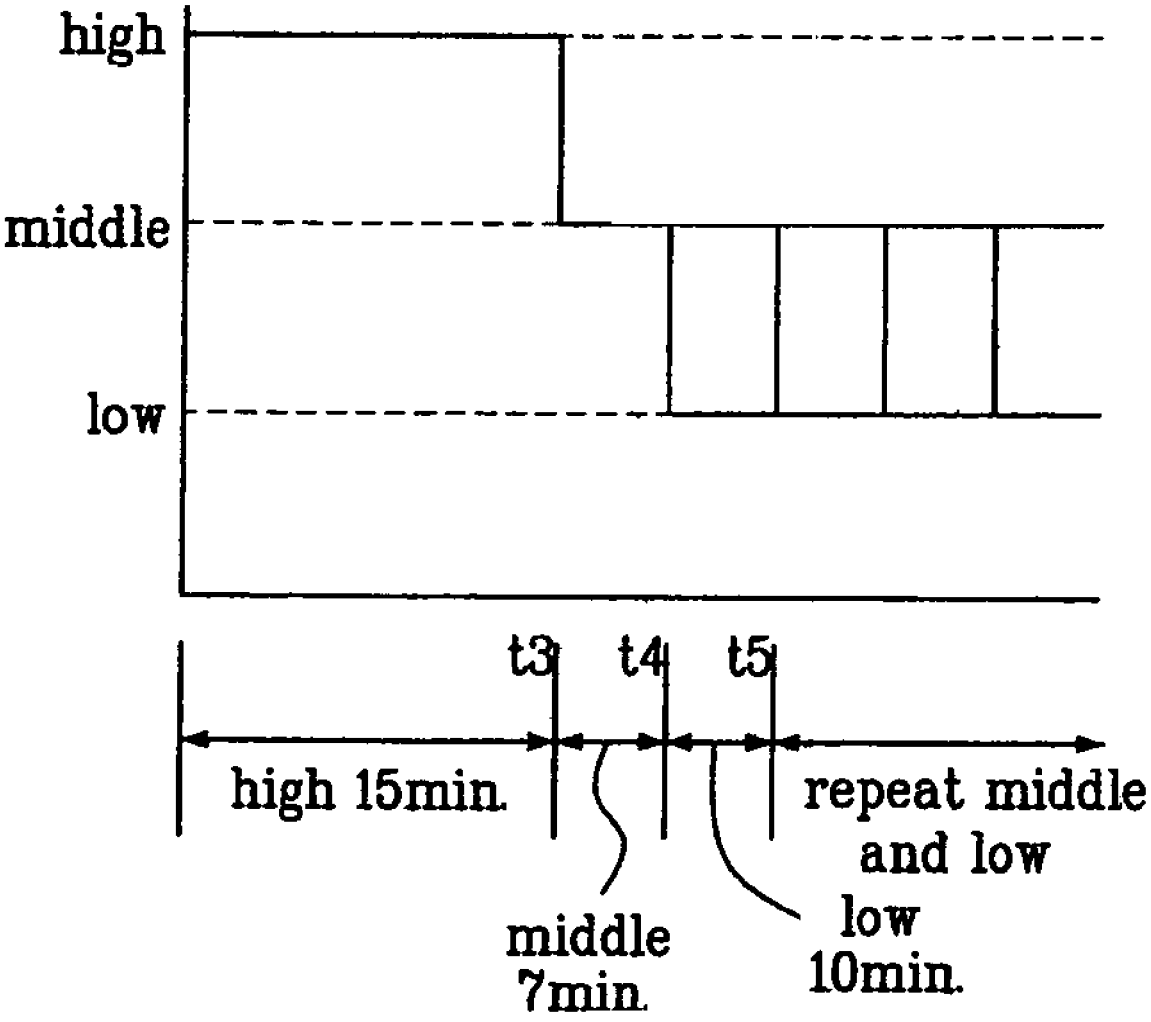
FIG. 5 illustrates a graph showing fan control in a yellow sand removal operation mode of the air conditioner of the present invention.
Figure 7:
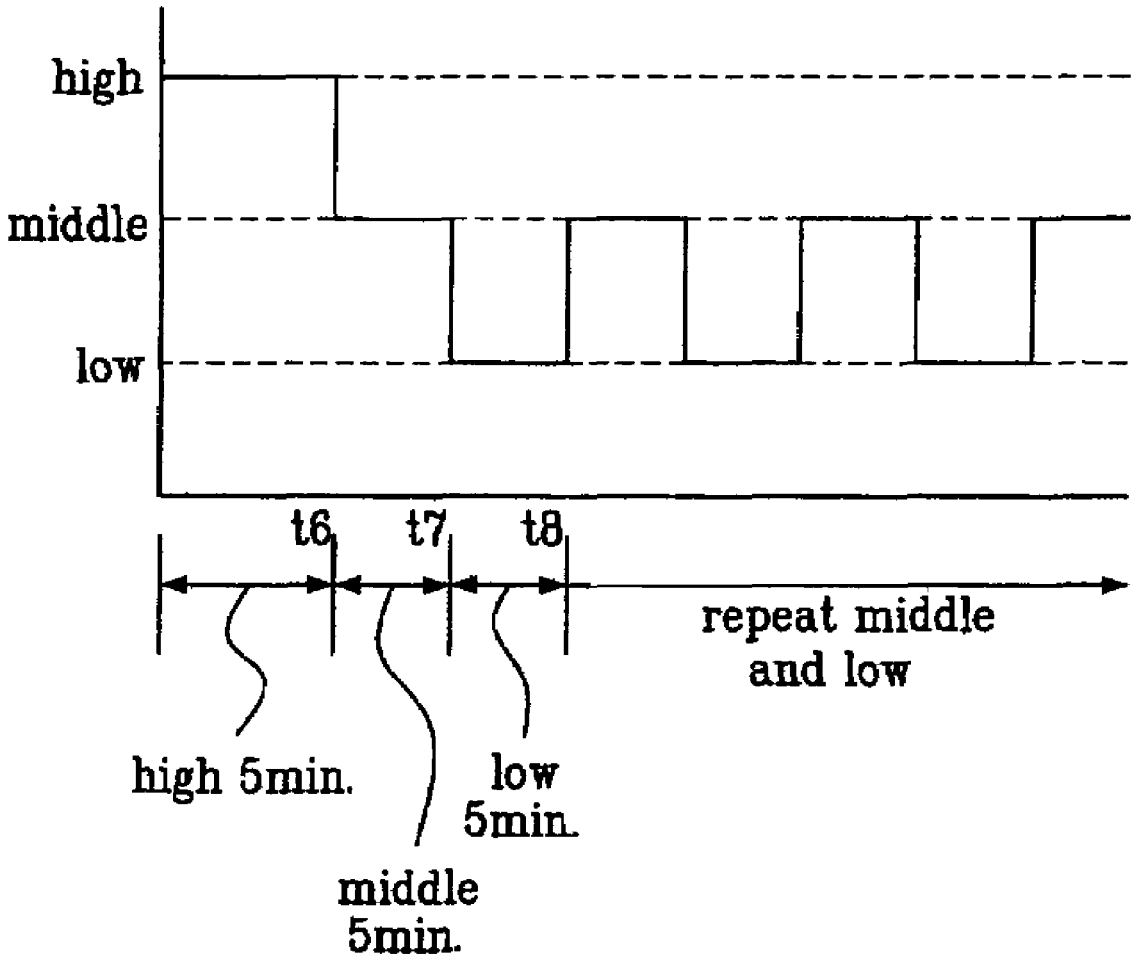
FIG. 7 illustrates a graph showing fan control in a pollen removal operation mode of the air conditioner of the present invention.

The memory 220 has operation control programs and operation control time periods for each of the buttons stored therein. That is, as shown in FIGS. 3, 5, and 7, the memory 220 has operation control programs, information on operation control time periods changed with the setting button 304, and information selected with the flow rate buttons 305, 306, and 307 for all the operation modes stored therein.

In this instance, it is required that an operation process following selection of the setting button 304 is stored in the memory 220 for each of the operation modes, separately. For an example, for each of the operation modes, it is required to store a basic data initially for selecting change of an operation time period of a particular section, or all sections according to a number of selection of the setting buttons 304. The number of selection of the setting button 304 for each of the operation modes is designed to select as the user likes according to a degree of air pollution. That is, the number of selection of the setting button 304 is adjusted for dealing with the degree of air pollution caused by yellow sand, or a state the number of cigarettes smoked in the room, effectively.

In the meantime, the display part 240 displays the present operation mode under the control of the controlling part 230. The display part 240 displays the operation time period of the present operation mode, a remained time period. The fan driving part 250 controls a rotation rate of the fan under the control of the controlling part 230. The air conditioner of the present invention has a compressor driving part 260. Though not shown, other than the compressor driving part 260, the air conditioner of the present invention has different parts (indoor, and outdoor heat exchangers, expansion devices, etc.,) for controlling cooling or heating. Since the different parts of the air conditioner for controlling cooling or heating are known, description of which will be omitted.

An operation process for cleaning air in the air conditioner in accordance with a preferred embodiment of the present invention will be described. When power is applied to the air conditioner, the fan driving part 250 is operated under the control of the controlling part 230, to drive a blowing device, for an example, the fan. When the fan rotates, air is drawn through the inlet 13 of the air conditioner in FIG. 1A, and cleaned at the duct collector 40 through a process shown in FIG. 1D. The cleaned air moves through a passage in the cabinet 10, and is discharged through the outlet 15.

When control of the air conditioner is carried out such that the polluted air is drawn and the cleaned air is discharged through the outlet 15 by rotating the fan, the user can control the rotation speed of the fan by the following method. First, the rotation speed of the fan can be controlled according to the flow rate selection buttons 305, 306, and 307 on the remocon 300. In this instance, the flow rate selection button selected at the remocon 300 is provided to the controlling part 230 through the mode input part 210, and the controlling part 230 drives the fan driving part 250 in a rotation speed for the selected button 305, 306, and 307.

In the meantime, when the air conditioner of the present invention carries out an air cleaning operation, the user can select an operation mode proper to the characteristics of a main pollution source that pollutes the room by using the remocon 300. In the present invention, there are two operation modes depending on combination of the operation sections.

Of the two operation modes, the first operation mode has a combination in which the first operation section, the second operation section, and the third operation section are arranged in succession. In the present invention, the first operation mode suggests an embodiment that specifically realizes as an operation mode for removing cigarette smoke.

The second operation mode, the other one of the two operation modes, has a combination in which, after the first operation section, the second operation section, and the third operation section are arranged in succession, the second operation section and the third operation section are repeated. In the present invention, the second operation mode suggests an embodiment that realizes as an operation mode for removing pollutants coming from yellow sand phenomenon, and as an operation mode for removing pollen differently depending on the operation time periods of the operation sections.

The different operation modes in which the fan is controlled to deal with different pollution sources, such as cigarette smoke, yellow sand, and pollen effectively, and processes in which the fan is controlled according to the selected operation mode, will be described in more detail with reference to the attached drawings.

Figure 4A:
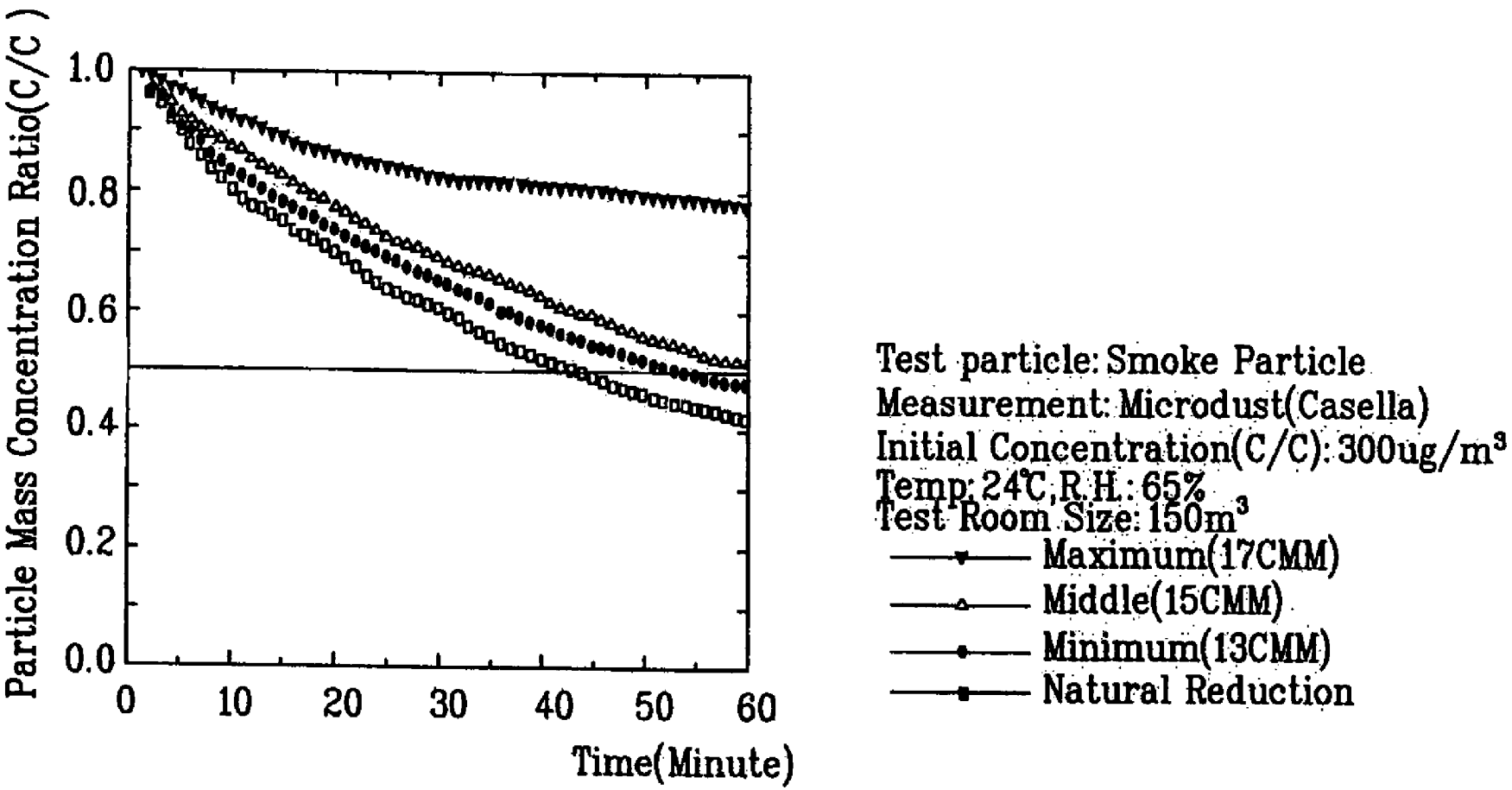
FIGS. 4A and 4B illustrate graphs each showing experimental data when the air conditioner of the present invention is operated in the operation mode of FIG. 3.
Figure 4B:
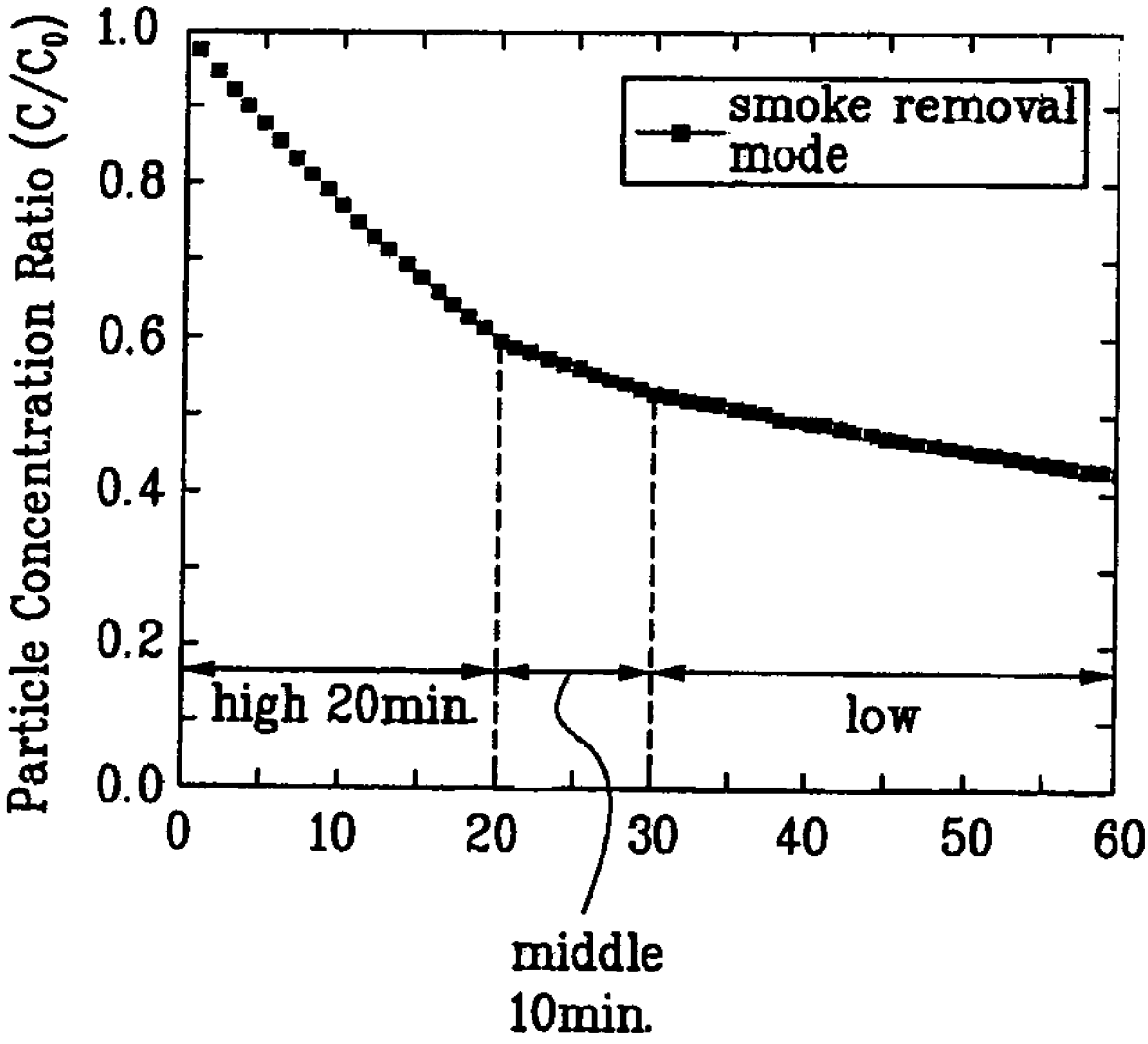
Figure 9:
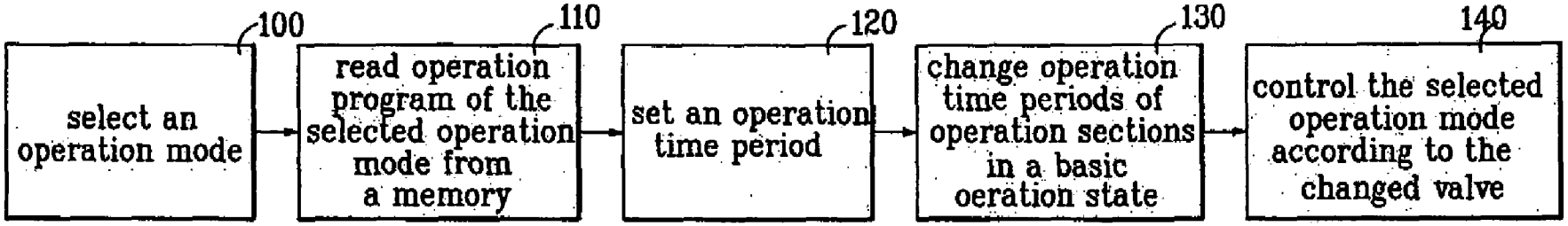
FIG. 9 illustrates a block diagram showing a method for controlling air cleaning operation of an air conditioner of the present invention.

FIG. 3 illustrates a graph showing fan control in a smoke removal operation mode of the air conditioner of the present invention, FIGS. 4A and 4B illustrate graphs each showing experimental data when the air conditioner of the present invention is operated in the operation mode of FIG. 3, and FIG. 9 illustrates a block diagram showing a method for controlling air cleaning operation of an air conditioner of the present invention.

When the user selects the smoke removal mode button 301, as the signal for the selected button is provided to the controlling part 230, the smoke removal mode control is sensed (step 100). Then, the controlling part 230 carries out the smoke removal mode.

Next, the controlling part 230 reads information on operation of the smoke removal mode from the memory 220 (step 110). Then, at an initial operation, the controlling part 230 operates the fan in 'high', the greatest flow rate, as shown in FIG. 3 according to the operation program for the smoke removal mode read from the memory 220. A 'high' operation time period is a first time period, i.e., a t1 time period. The t1 time period is set to a time period in which smoke particle concentration drops down to an environmental criterion adequately, such as approx. 20 minutes.

Then, when the t1 time period passes, the fan is operated in 'middle' which has an intermediate flow rate. The time period the fan is operated in 'middle' is a second time period, i.e., until a t2 time is reached. The t2 time, an operation time for removal of remained smoke, can be set to, for an example, 10 minutes.

When the t2 time passes, the fan is operated in 'low' having least flow rate until the smoke removal operation mode is finished. Meanwhile, the t1 and t2 time periods are set different from each other for different capacities and sizes with reference to the embodiment illustrated.

If the smoke removal mode is operated according to above operation, a reduction of power consumption at least more than 14.2% is possible in comparison to a case the high, or low operation is maintained for the same time period. Moreover, noise caused by rotation of the fan also can be reduced by 10.1%.

The foregoing operation process of the smoke removal mode represents a control process of the fan when the user operates a basic smoke removal mode by using the remocon 300. However, since people in the room always do smoke only two cigarettes, it is required that the operation time period of the smoke removal mode is varied with a room environment.

In the present invention, the operation time periods of the respective operation sections can be varied with the operation modes. That is, in the smoke removal mode in FIG. 3, the operation time period may be changed for the first section, i.e., the section up to the t1 time, or for all the sections up to the t2 time including the t1 time can be changed, depending on user's selection. After the operation time control for the section up to the t2 time is finished, alike the basic operation state, a control for maintaining the 'low' operation can be carried out. Methods for changing the operation time periods of the operation sections will be described.

When the fan is operated in the smoke removal operation mode, the user presses the setting button 304 to set the operation time period as desired (step 120). Then, sensing the operation time period of the operation section the user sets by pressing the setting button 304, the controlling part 230 determines adjustment of the operation time period only of the section up to t1 time, or all the sections including t1 and t2 time, and controls the rotation speed of the fan according to the adjusted respective sections. In this instance, the adjustment of the operation time periods of respective operation sections can be made by multiplying the number 'n' of pressing times of the setting button 304 set by the user to a constant 'a' based on a basic value of the smoke removal mode and characteristics of the smoke removal mode (step 130, and step 140).

Figure 6A:
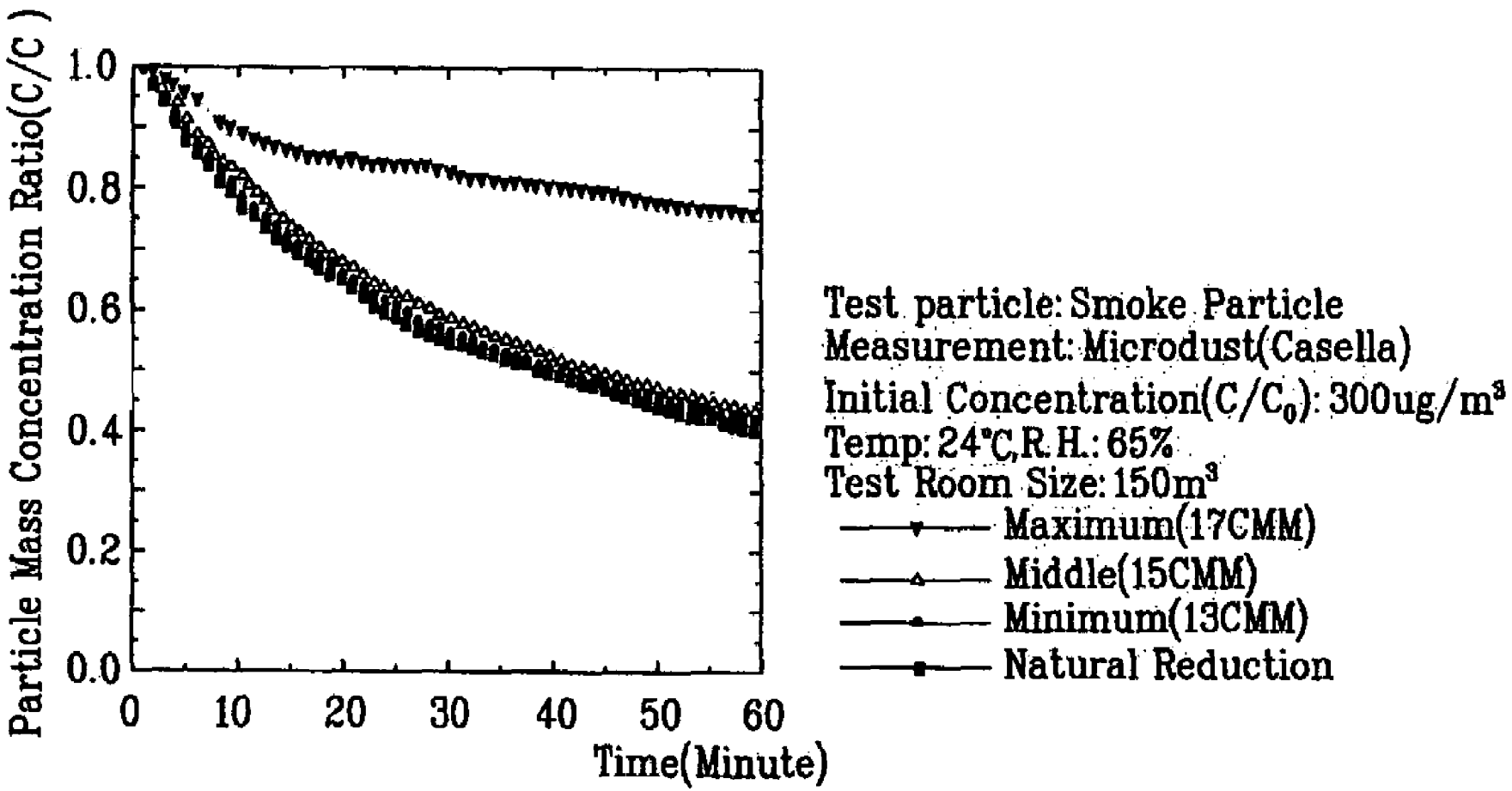
FIGS. 6A and 6B illustrate graphs each showing experimental data when the air conditioner of the present invention is operated in the operation mode of FIG. 5.
Figure 6B:
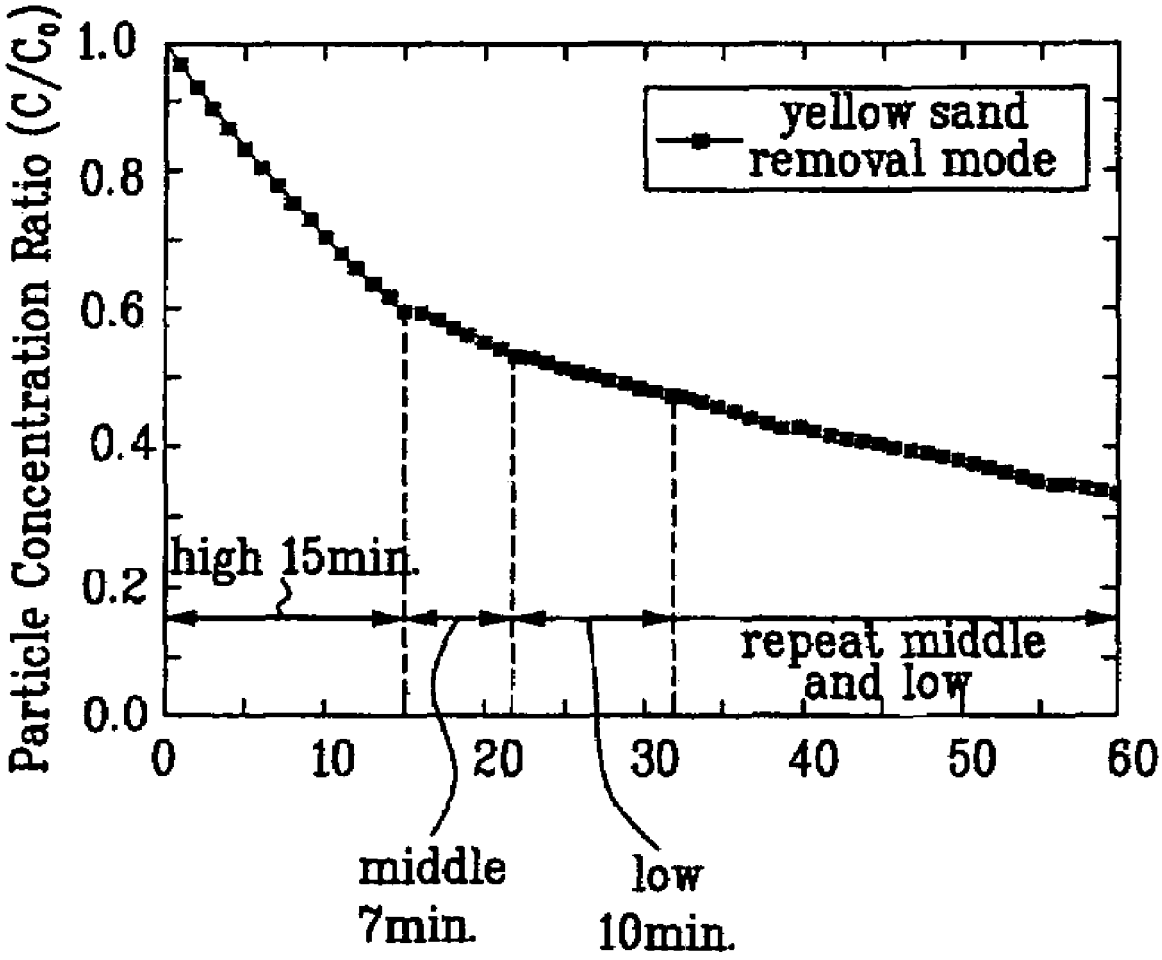

Next, if the user selects the yellow sand removal mode 302, as a signal relevant to the selected button is provided to the controlling part 230, the controlling part 230 senses the yellow sand removal mode. Then, the controlling part 230 carries out the yellow sand removal mode. FIG. 5 illustrates a graph showing fan control in a yellow sand removal operation mode of the air conditioner of the present invention, and FIGS. 6A and 6B illustrate graphs each showing experimental data when the air conditioner of the present invention is operated in the operation mode of FIG. 5, referring to which the yellow sand removal mode will be described.

If the yellow sand removal mode is selected, the controlling part 230 reads information on operation program of the yellow sand removal mode from the memory 220. Then, as shown in FIG. 5, according to the operation program of the yellow sand removal mode, the fan is operated at 'high' in the highest flow rate in the initial operation. A time period operated at 'high' is a t3 time period. The t3 time period is a time period determined according to an experimental value until a concentration of the yellow sand drops down below a certain level from shown size and capacity, for an example, in a range of 15 minutes.

When the t3 time period is passed, the fan is operated at 'middle' in an intermediate flow rate until the yellow sand removal mode is finished. The fan operation time period at middle is a t4 time period. The t4 time period, an operation time period until a room particle concentration drops down to an environmental criterion, may be set, for an example, to 7 minutes. Then, the fan is operated at 'low' having least flow rate for a t5 time period.

Referring to FIG. 5, after the foregoing control is made, the controlling part 230 controls the fan to repeat the middle and low. Time periods of the repetitive middle and low may or may not be the same. For an example, after the t5 time period, the middle and the low may be repeated for 10 minutes each, or the middle and the low may be repeated for 7 minutes and 10 minutes respectively.

When the yellow sand removal mode is controlled according to the foregoing operation process in the present invention, at least 14.3% of saving of power consumption is possible, and a 10% reduction of noise coming from the fan is also possible, compared to a case the fan operation is continued at the middle or low.

The foregoing operation process is a fan control process when the user puts the basic yellow sand removal mode into operation by using the remocon. However, since the concentration of the yellow sand is not always constant, it is required to change the operation time period of the yellow sand removal mode according to a room environment.

As the present invention can change the operation time periods of the operation sections, adjustment of operation time periods is possible in the yellow sand removal mode, too. That is, in the yellow sand removal mode in FIG. 5, the operation time period may be changed only for the section of the t3 time period, or for all the sections of the t3, t4, and t5 time periods. Then, alike the state of FIG. 5, after finish of operation of the section of the t3 time period, the high and the low are repeated. A method for changing the operation time period of the operation section will be described.

In the operation of the yellow sand removal mode, the user presses the setting button 304, to set the operation time period as desired. Then, sensing the operation time period the user sets by pressing the setting button 304, the controlling part 230 determines whether the adjustment is carried out for the section of the t3 time period or for all sections of the t3, t4, and t5 time periods, and controls the rotation speed of the fan according to the adjusted time periods of the sections. In this instance, the adjustment of the operation time periods of the operation sections is obtained by multiplying a constant 'b' based on a basic value of the yellow sand removal mode and characteristics of preset yellow sand removal mode to the number 'n' of selection times of the setting button the user selects.

Figure 8A:
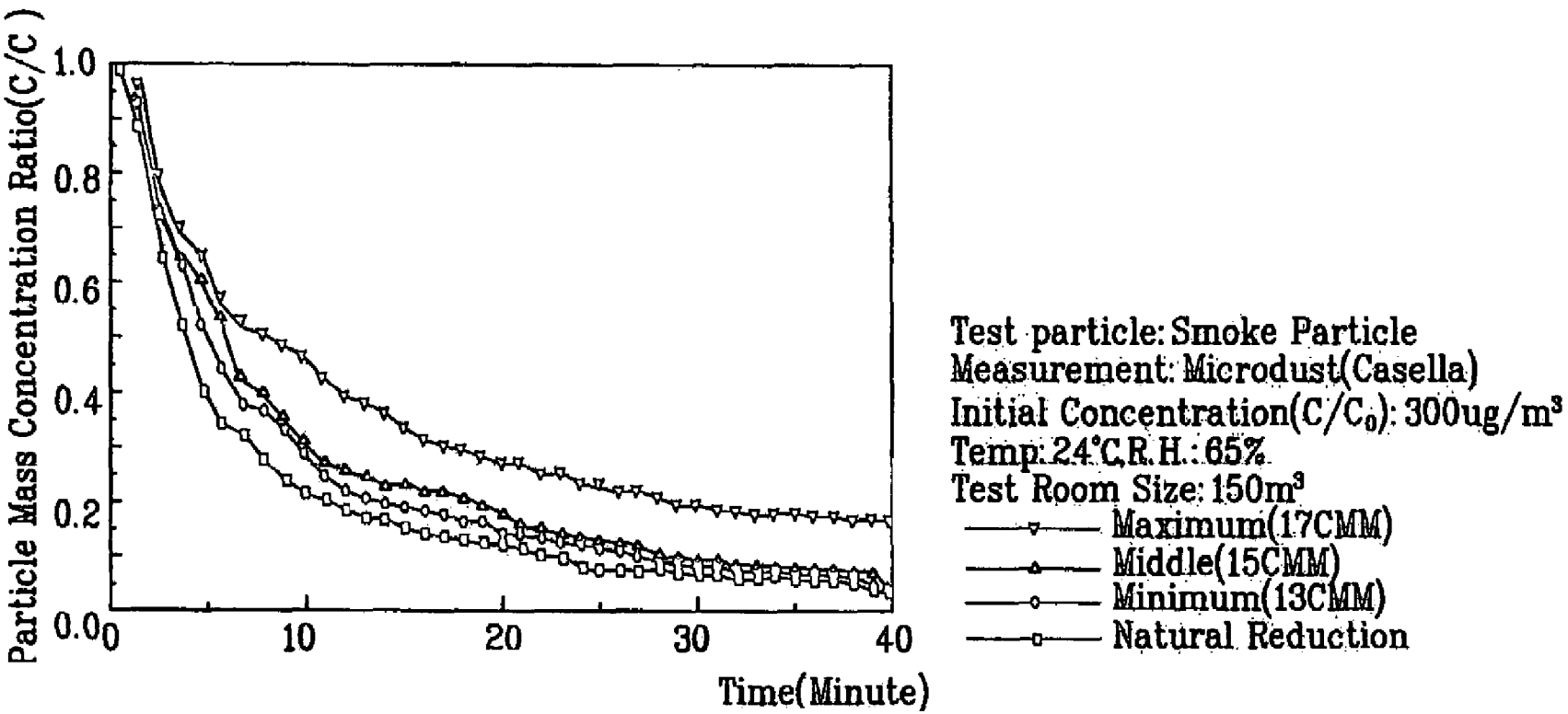
FIGS. 8A and 8B illustrate graphs each showing experimental data when the air conditioner of the present invention is operated in the operation mode of FIG. 7.
Figure 8B:
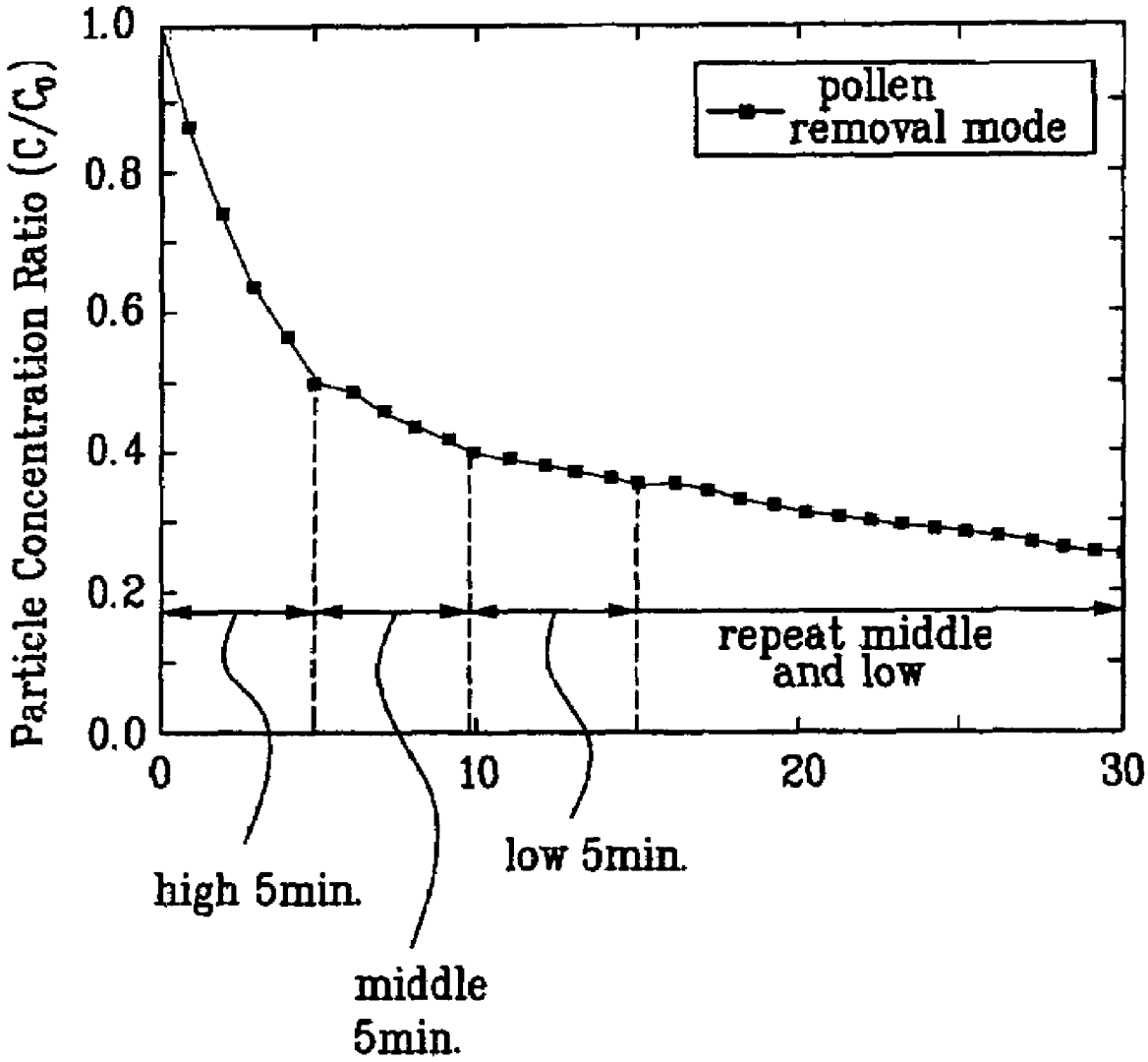

Lastly, the present invention suggests an operation process for adjusting the flow rate and operation time period of the fan in the pollen removal mode. FIG. 7 illustrates a graph showing fan control in a pollen removal operation mode of the air conditioner of the present invention, and FIGS. 8A and 8B illustrate graphs each showing experimental data when the air conditioner of the present invention is operated in the operation mode of FIG. 7. The pollen removal mode will be described with reference to above drawings.

If the user selects a pollen removal mode button 303 on the remocon 300, the controlling part 230 reads information on operation program for the pollen removal mode from the memory 220. Then, as shown in FIG. 7, according to the operation program of the pollen removal mode, the fan is operated at 'high' in a maximum flow rate in an initial operation. During a time period t6 the fan is operated at high, a time period a steady flow of air can be produced in the room, pollen particles in the air is removed. The t6 time period, set as a time period determined by an experimental value the pollen can be removed in the shown size and capacity, may be set, for an example, to a range of 5 minutes.

Next, when the t6 time period is passed, the fan is operated in middle, in a middle flow rate, to change an air flow for removal of remained pollen particles. The middle fan operation time period is t7. The t7 time period may be, for an example, in a range of 5 minutes. Then, the fan is operated at low, in the least flow rate, for t8 time period, which may be set to be in a range of 5 minutes. After the foregoing control, the controlling part 230 controls the fan to repeat the middle and the low. In this case too, the middle and the low may be repeated for the same, or different time periods.

In a case the pollen removal mode is operated in the foregoing process in the present invention, at least 16.8% of power consumption is saved, and at least 11.6% of noise caused by the fan rotation is reduced, in comparison to a case the fan is kept to run at high or middle.

The operation process is a fan operation process in a case the user puts the basic pollen removal mode into operation by using the remocon 300. However, since the pollen particle concentration is not always constant, it is required to change the operation time period of the pollen removal mode depending on a room environment.

In this case, similar to the smoke removal mode or the yellow sand removal mode, the user may press the setting button 304, to change the operation time period only of the section of the t6 time period, or the operation time periods of all sections of t6, t7, and t8 time periods. After the operation of the section of the t3 time period is finished, alike the basic operation, the high and the low are repeated. The method for changing the operation time periods of the operation sections thus will be reviewed.

In the pollen removal mode, the user presses the setting button 304, to set the operation time as desired. Then, the controlling part 230 senses the operation time period the user sets, determines whether adjustment of the operation time period of the section of the t6 time period only is carried out or adjustment of the operation time periods of the sections of the t6, t7, and t8 time periods only is carried out, and controls the rotation speed of the fan according to the adjusted operation time periods of the sections. In this case, the adjustment of the operation time periods of the operation sections is obtained by multiplying a constant 'c' based on a basic value of the pollen removal mode and preset characteristics of the pollen removal mode to the number 'n' of selection times of the setting button the user sets.

As has been described, the present invention sets different operation modes to deal with different pollutants for removal of pollutant particles from air and cleaning the air. In this instance, operation programs having different flow rates and operation times are stored for different operation modes. Moreover, the user can adjust the operation time periods set for each of the operation modes. That is, according to degrees of pollution, the operation time period of the operation mode is adjusted. In this instance, the operation time period of a particular operation section of the operation mode, or a total operation time period of all operation sections of the operation mode may be adjusted.

The foregoing present invention has the following advantages.

First, in an air conditioner with an air cleaner for drawing polluted air and cleaning the polluted air into cleaned air, by varying the operation time period and the rotation speed of the fan, different measures to different pollutants are possible. According to this, an advantage can be obtained, in which fast and efficient air cleaning proper to kind of pollutant is possible. Second, since the operation time period can be changed according to degree of pollution, more efficient air cleaning is possible. Third, energy consumption and noise are reduced in comparison to continued high or middle flow rate operation.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A device for controlling air cleaning operation of an air conditioner comprising:

a memory, the memory storing a plurality of operation modes respectively corresponding to cigarette smoke, yellow sand and pollen for controlling operation of a fan, the fan for drawing air, and discharging the air through an air cleaner in the air conditioner;

first means for selecting one of the plurality of operation modes stored in the memory; and a controlling part for controlling the fan according to a control program of the operation mode selected by using the first means.

2. The device as claimed in claim 1, wherein the operation mode includes a plurality of operation sections operative in different characteristics.

3. The device as claimed in claim 2, further comprising a second means for changing setting of the operation time periods of the operation modes.

4. The device as claimed in claim 3, wherein the controlling part controls the fan by reading the operation mode selected with the first means from the memory, and adjusts the operation time period of the operation mode to a value set with the second means.

5. The device as claimed in claim 3, wherein the second means changes setting of a total operation time period of all operation sections in the operation mode.

6. The device as claimed in claim 3, wherein the second means changes setting of individual operation time periods of the operation sections of the operation mode, respectively.

7. The device as claimed in claim 2, wherein the operation mode includes:

a first section for operating the fan to output a maximum air flow rate, a second section for operating the fan to output a middle air flow rate lower than the maximum air flow rate, and a third section for operating the fan to output a least air flow rate lower than the middle air flow rate.

8. The device as claimed in claim 7, wherein the operation mode includes a first mode having the first section, the second section, and the third section operative in succession.

9. The device as claimed in claim 8, wherein the first mode for removal of the cigarette smoke includes:

the first section operative for a first time period, the second section operative for a second time period after finish of the first section, and the third section operative until the first mode ends after finish of the second section.

10. The device as claimed in claim 7, wherein the operation mode includes a second mode in which the second section and the third section are operated repeatedly after the first section, the second section, and the third section are operated in succession.

11. The device as claimed in claim 10, wherein the second mode for removal of the yellow sand includes:

the first section operative for a third time period, the second section operative for a fourth time period after finish of the first section, the third section operative for a fifth time period after finish of the second section, and a repetitive section for repeating the second section and the third section until the second mode ends after finish of the third section.

12. The device as claimed in claim 11, wherein the repetitive section includes the second section and the third section having identical operation time periods.

13. The device as claimed in claim 11, wherein the repetitive section includes the second section and the third section having different operation time periods.

14. The device as claimed in claim 10, wherein the second mode for removal of the pollen includes: the first section operative for a sixth time period, the second section operative for a seventh time period after finish of the first section, the third section operative for an eighth time period after finish of the second section, and a repetitive section for repeating the second section and the third section until the second mode ends after finish of the third section.

15. The device as claimed in claim 14, wherein the repetitive section includes the second section and the third section having identical operation time periods.

16. The device as claimed in claim 14, wherein the repetitive section includes the second section and the third section having different operation time periods.

17. A method for controlling air cleaning operation of an air conditioner having an air cleaner and a fan for supplying air to the air cleaner, comprising the steps of:

selecting one of a plurality of operation modes respectively corresponding to cigarette smoke, yellow sand and pollen, the plurality of operation modes being programmed to control the fan and stored in a memory;

changing setting of an operation time period of the selected operation mode;

reading the selected operation mode from the memory, and changing the operation time period of the operation mode to a set value; and controlling the fan according to the set value of the changed operation time period and a value of the operation mode read from the memory.

18. The method as claimed in claim 17, wherein the operation mode includes a plurality of operation sections for operating the fan in different characteristics.

19. The method as claimed in claim 17, wherein the step of changing setting of an operation time period of the selected operation mode includes the step of changing setting of a total operation time period of the operation mode.

20. The method as claimed in claim 18, wherein the step of changing setting of an operation time period of the selected operation mode includes the step of changing setting of individual operation time periods of the operation sections of the operation mode, respectively.

* * * * *